US012616342B2

(12) United States Patent
Casteel et al.

(10) Patent No.: US 12,616,342 B2
(45) Date of Patent: May 5, 2026

(54) COMPACT MULTI-CHAMBER FOAM-AT-A-DISTANCE PUMPS AND DISPENSERS

(71) Applicant: GOJO Industries, Inc., Akron, OH (US)

(72) Inventors: Stephen Casteel, Canal Fulton, OH (US); Nick E. Ciavarella, Seven Hills, OH (US); John J. McNulty, Broadview Heights, OH (US)

(73) Assignee: GOJO Industries, Inc., Akron, OH (US)

( * ) Notice: Subject to any disclaimer, the term of this patent is extended or adjusted under 35 U.S.C. 154(b) by 112 days.

(21) Appl. No.: 18/604,894

(22) Filed: Mar. 14, 2024

(65) Prior Publication Data

US 2024/0309866 A1 Sep. 19, 2024

Related U.S. Application Data

(60) Provisional application No. 63/490,848, filed on Mar. 17, 2023.

(51) Int. Cl.
*A47K 5/12* (2006.01)
*A47K 5/14* (2006.01)
(Continued)

(52) U.S. Cl.
CPC ..... *A47K 5/1208* (2013.01); *A47K 5/14* (2013.01); *A47K 5/16* (2013.01); *F04B 43/026* (2013.01); *F04B 43/04* (2013.01); *F04B 45/043* (2013.01); *F04B 45/047* (2013.01); *F04B 53/106* (2013.01); *A47K 5/12* (2013.01); *F04B 53/1047* (2013.01)

(58) Field of Classification Search
CPC ..... A47K 5/12; A47K 5/1208; A47K 5/14; A47K 5/16; F04B 43/026; F04B 43/04; F04B 45/043; F04B 45/047; F04B 53/106; F04B 53/1047
USPC ..... 137/855
See application file for complete search history.

(56) References Cited

U.S. PATENT DOCUMENTS 6,871,679 B2 3/2005 Last
7,647,954 B2 1/2010 Garber et al.
(Continued)

FOREIGN PATENT DOCUMENTS

WO WO-2024015699 A1 * 1/2024 ..... B05B 7/005

*Primary Examiner* — Charles G Freay
(74) *Attorney, Agent, or Firm* — Calfee, Halter & Griswold LLP

(57) ABSTRACT

Exemplary compact multi-chamber diaphragm pumps and dispensers for dispensing foam soap or sanitizer are disclosed herein. An exemplary pump for pumping soap or sanitizer and air separately to be mixed remote from the pump and dispensed as a foam includes a liquid pump diaphragm and a dual flapper valve, wherein a first of the dual flapper valves is a liquid inlet valve and a second of the dual flapper valves is a liquid outlet valve. The pump further includes two or more air pump diaphragms and a valve plate. The valve plate has a liquid inlet passage, a liquid outlet passage, a liquid outlet valve seat, two or more air inlet passages, two or more air inlet valve anchors and two or more air inlet valves secured to the valve plate. A pump manifold is also included, the pump manifold includes a liquid inlet valve seat.

20 Claims, 4 Drawing Sheets

(51) Int. Cl.

| | |
|---|---|
| ***A47K 5/16*** | (2006.01) |
| ***F04B 43/02*** | (2006.01) |
| ***F04B 43/04*** | (2006.01) |
| ***F04B 45/04*** | (2006.01) |
| ***F04B 45/047*** | (2006.01) |
| ***F04B 53/10*** | (2006.01) |

(56) References Cited

U.S. PATENT DOCUMENTS

| | | | | |
|---|---|---|---|---|
| 8,960,498 | B2 | 2/2015 | Wegelin et al. | |
| 10,143,339 | B2 | 12/2018 | Ciavarella et al. | |
| 10,912,426 | B2 * | 2/2021 | Harris | A47K 5/14 |
| 2014/0054322 | A1 | 2/2014 | Mcnulty et al. | |
| 2014/0234140 | A1 | 8/2014 | Curtis et al. | |
| 2015/0251841 | A1 | 9/2015 | Mcnulty et al. | |
| 2015/0255179 | A1 * | 9/2015 | Rosen | G21C 9/016 376/280 |
| 2015/0266657 | A1 | 9/2015 | Corney | |
| 2016/0029855 | A1 | 2/2016 | Harris et al. | |

* cited by examiner

COMPACT MULTI-CHAMBER FOAM-AT-A-DISTANCE PUMPS AND DISPENSERS

CROSS-REFERENCE TO RELATED APPLICATIONS

This application claims priority to and any benefit of U.S. Provisional Application No. 63/490,848, filed Mar. 17, 2023, the content of which is incorporated herein by reference in its entirety.

BACKGROUND OF THE INVENTION

Touch-free foam and soap dispensers are well known. These dispensers are typically battery powered and may be mounted on a wall. The pump and drive systems typically require a large footprint, and as a result, there are instances where one would desire to have a touch-free soap or sanitizer dispenser, however, due to space constraints, only manual dispensers may work in the desired area. In addition, the power consumption required by components of many dispensers result in large batteries being needed to store enough energy to operate the soap or sanitizer for a desired period of time or desired number of dispenses. Accordingly, there is a need for more compact soap and sanitizer dispensers as well as a need to conserve energy during dispensing of soap or sanitizer.

SUMMARY OF THE INVENTION

Exemplary compact multi-chamber diaphragm pumps and dispensers for dispensing foam soap or sanitizer are disclosed herein. An exemplary pump for pumping soap or sanitizer and air separately to be mixed remote from the pump and dispensed as a foam includes a liquid pump diaphragm and a dual flapper valve, wherein a first of the dual flapper valves is a liquid inlet valve and a second of the dual flapper valves is a liquid outlet valve. The pump further includes two or more air pump diaphragms and a valve plate. The valve plate has a liquid inlet passage, a liquid outlet passage, a liquid outlet valve seat, two or more air inlet passages, two or more air inlet valve anchors and two or more air inlet valves secured to the valve plate. A pump manifold is also included, the pump manifold includes a liquid inlet valve seat.

An exemplary soap or sanitizer dispenser includes a housing, a foam dispensing outlet, reservoir, a motor, a wobble plate and a pump. The pump includes a liquid pump diaphragm, two or more air pump diaphragms and a valve plate. The valve plate includes a liquid inlet passage, a liquid outlet passage, two or more air inlet passages, one or more air outlet passages and a liquid outlet valve seat. The pump further includes a manifold. The manifold includes a liquid inlet valve seat. A dual flapper valve is also included. One of the valves in the dual flapper valve is a liquid inlet valve and the other is a liquid outlet valve.

Another exemplary pump for pumping soap or sanitizer and air includes a multi-chamber diaphragm. The multi-chamber diaphragm includes a liquid pump chamber and two or more air pump chambers. The pump further includes a valve plate. The valve plate has a liquid inlet passage, a liquid outlet passage, a liquid outlet valve seat, two or more air inlet passage, two or more air inlet valve anchors. Two or more air inlet valves are secured to the valve plate. The pump further includes a pump manifold that has a liquid inlet valve seat. In addition, the pump includes a dual flapper valve. A first of the dual flapper valves is a liquid inlet valve and a second of the dual flapper valves is a liquid outlet valve. A first periphery of the dual flapper valve forms a seal against the valve plate and a second periphery of the dual flapper valve forms a seal against the manifold.

BRIEF DESCRIPTION OF DRAWINGS

To further clarify various aspects of the present disclosure, a more particular description of inventive concepts will be made by reference to various aspects of the appended drawings. It is appreciated that these drawings depict only typical embodiments of the present disclosure and are therefore not to be considered limiting of the scope of the disclosure. Moreover, while the figures can be drawn to scale for some embodiments, the figures are not necessarily drawn to scale. Features and advantages of the present disclosure will be described and explained with additional specificity and detail through the use of the accompanying drawings in which.

DETAILED DESCRIPTION OF THE INVENTION

Figure 1:
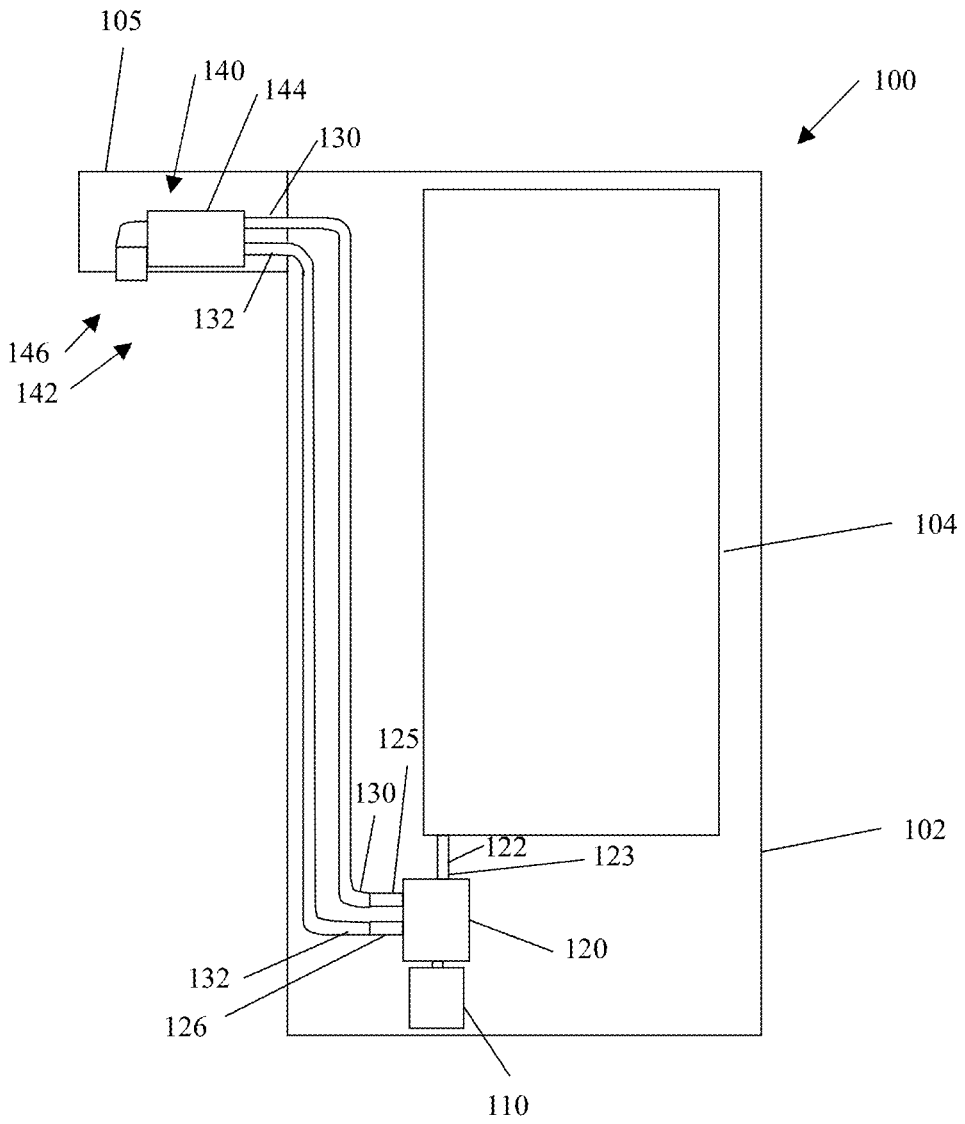
FIG. 1 is simplified schematic view of an exemplary soap or sanitizer dispenser with a pump configured to provide air and liquid to a foam-at-a-distance dispensing nozzle.

The following description refers to the accompanying drawings, which illustrate specific aspects of the present disclosure.

As described herein, when one or more components are described as being connected, joined, affixed, coupled, attached, or otherwise interconnected, such interconnection may be direct as between the components or may be indirect such as through the use of one or more intermediary components. Also as described herein, reference to a "member," "component," or "portion" shall not be limited to a single structural member, component, or element but can include an assembly of components, members, or elements. Also as described herein, the terms "substantially" and "about" are defined as at least close to (and includes) a given value or state (preferably within 10% of, more preferably within 1% of, and most preferably within 0.1% of).

"Circuit communication" as used herein indicates a communicative relationship between devices. Direct electrical, electromagnetic and optical connections and indirect electrical, electromagnetic and optical connections are examples of circuit communication. Two devices are in circuit communication if a signal from one is received by the other, regardless of whether the signal is modified by some other device. For example, two devices separated by one or more of the following—amplifiers, filters, transformers, optoisolators, digital or analog buffers, analog integrators, other electronic circuitry, fiber optic transceivers or satellites—are in circuit communication if a signal from one is communicated to the other, even though the signal is modified by the intermediate device(s). As another example, an electromagnetic sensor is in circuit communication with a signal if it receives electromagnetic radiation from the signal. As a final example, two devices not directly connected to each other, but both capable of interfacing with a third device, such as, for example, a CPU, are in circuit communication.

Voltages and values representing digitized voltages are considered to be equivalent for the purposes of this application, and thus the term "voltage" as used herein refers to either a signal, or a value in a processor representing a signal, or a value in a processor determined from a value representing a signal.

"Signal", as used herein includes, but is not limited to one or more electrical signals, analog or digital signals, one or more computer instructions, a bit or bit stream, or the like.

"Logic," synonymous with "circuit" as used herein includes, but is not limited to hardware, firmware, software and/or combinations of each to perform a function(s) or an action(s). For example, based on a desired application or needs, logic may include a software controlled microprocessor or microcontroller, discrete logic, such as an application specific integrated circuit (ASIC) or other programmed logic device. Logic may also be fully embodied as software. The circuits identified and described herein may have many different configurations to perform the desired functions. The exemplary methodologies provide instructions for creating logic to control desired functions.

Values identified in the detailed description may be exemplary and may be different as needed for a particular dispenser and/or refill design. Accordingly, the inventive concepts disclosed and claimed herein are not limited to the particular values or ranges of values used to describe the embodiments disclosed herein.

The term "remote" as used herein means that the remote foam generator is located at least 3" from the liquid outlet and air outlet of the pump.

The single sequentially activated multi-diaphragm pumps disclosed herein, pump liquid and air through separate conduits to the remote foam generator where the liquid and air are mixed together. The remote foam generator includes an outlet for dispensing foam into a user's hand. In some exemplary embodiments, the remote foam generator is located at a point higher than the pump. In some embodiment, the sequentially activated multi-diaphragm pump is located below a countertop and the remote foam generator is located above the countertop. In some embodiments, the sequentially activated multi-diaphragm pump is located in the base of a dispenser and the remote foam generator and outlet nozzle are located near the top of the dispenser.

In some embodiments of the present invention, the foam that is dispensed is created with an air to liquid ratio of between about 5 to 1 and about 15 to 1. In some embodiments, the air to liquid ratio between about 6 to 1 and about 12 to 1. In some embodiments, the air to liquid ratio between about 7 to 1 and about 10 to 1. In some embodiments, the air to liquid ratio between about 8 to 1 and about 12 to 1. In some embodiments, the air to liquid ratio between about 9 to 1 and about 12 to 1. In some embodiments, the air to liquid ratio between about 10 to 1 and about 12 to 1.

FIG. 1 illustrates an exemplary embodiment of a dispenser 100. In this exemplary embodiment, dispenser 100 is a self-contained dispenser and sits on a countertop, a table, or the like. In some embodiments, the dispenser may be a counter-mount dispenser (not shown) having a spout located above the countertop and the pump and container located below the countertop. In some embodiments, dispenser 100 is a surface mounted dispenser, such as, for example, a wall mounted dispenser or a stand mounted dispenser.

Dispenser 100 includes a housing 102. A removable and replaceable refill unit or reservoir 104 is included. The refill unit or reservoir 104 is in fluid communication with a liquid inlet of pump 120 through conduit 122. In this exemplary embodiment, reservoir 104 is located within housing 102. In some embodiments, reservoir 104 is located partially within housing 102. In some embodiments, reservoir 104 is located on top of at least a portion of housing 102. In some embodiments, reservoir 104 is located at the bottom of housing 102. In some embodiments, at least a portion of the reservoir 104 is located below the housing 102. In some embodiments, at least a portion of the reservoir 104 is visible during use.

The term reservoir, container or bottle may be used interchangeably. In addition, in some embodiments, a refill unit may also be used interchangeably with container, bottle or reservoir. The term refill unit means a container, reservoir or bottle that may be readily removed from the dispenser and replaced with a new refill unit. A refill unit may include a closure, a liquid outlet, an air inlet, or the like. In some embodiments, a refill unit may include a pump. The dispensers disclosed herein may also be used with a refillable reservoir.

In some instances, reservoir 104 is a sealed reservoir and is a non-collapsing reservoir. Accordingly, a vent valve (not shown) is typically included. In some instances, reservoir 104 is a collapsing reservoir and a vent valve is not required. Preferably when a reservoir 104 is a collapsing reservoir, the reservoir is located within housing 102 so as to not be visible to a consumer unless the dispenser is opened up.

Located in the base of housing 102 is a motor 110 and a pump 120. Pump 120 is a sequentially activated multi-diaphragm pump and is located bellow reservoir 104. In some embodiments, pump 120 is located above reservoir 104. In some embodiments, pump 120 is located along side of the reservoir 104.

In this exemplary embodiment, liquid inlet 123 is located on the top of sequentially activated multi-diaphragm pump 120. Sequentially activated multi-diaphragm pump 120 has a liquid outlet 126. In this exemplary embodiment, a portion of an air outlet 125 extends along a central axis of the pump.

Air outlet 125 is in fluid communication with remote foam generator 140 through air conduit 130. Liquid outlet 126 is in fluid communication with the remote foam generator 140 through liquid conduit 132.

Over each operating cycle, multi-diaphragm pump 120 pumps a discrete dose of liquid into liquid conduit 132 and two or more discrete doses of air into air conduit 130. Once the system is filled with liquid, each pump revolution dispenses a discrete dose of liquid into remote foam generator 140. Similarly, each pump revolution dispenses at least two discrete volumes of air flow into the remote foam generator 140. Multiple operating cycles or pump revolutions are typically required for each dose of foam that is dispensed from the outlet 146.

Liquid and air are mixed together in remote foam generator 140. The mixture may be forced through an optional foaming media, which may be, for example, one or more screens and/or a sponge, and is dispensed out of dispensing outlet 146 as a foam.

In this exemplary embodiment, remote foam generator 140 and dispensing outlet 146 are located in an overhanging section 105 of housing 102. Dispensing outlet 146 is located in a position that allows a user to place her hand under the dispensing outlet 146 and receive a dose of foam.

Dispenser 100 includes electrical components (not shown) that are required for operating dispenser 100 in a touch-free manner. The electrical components include: one or more power sources, such as, for example, one or more batteries; a microprocessor; a sensor for sensing an object proximate the outlet nozzle; a motor; circuitry for activating the motor to drive the sequentially activated multi-diaphragm pump 120; logic for causing the processor to control the functions of the dispenser 100; optional indicating lights; and any other circuitry required to perform the required functions. Some exemplary touch-free dispenser components that may be used in accordance with the present invention are shown and described in U.S. Pat. No. 8,960,498 titled Touch-Free Dispenser With Single Cell Operation And Battery Banking; U.S. Pat. Pub. No. 2014/00543.22 titled Off-Axis Inverted Foam Dispensers And Refill Units and Pub. No. 2014/0234140 titled Power Systems For Touch Free Dispensers And Refill Units Containing a Power Source, which are incorporated herein by reference in their entirety.

Reservoir 104 is preferably removable and replaceable. Accordingly, when reservoir 104 is out of fluid or needs replaced, reservoir 104 may be removed from dispenser 100 and a new reservoir 104 may be installed. In some embodiments, reservoir 104 may be a permanent reservoir that has soap or sanitizer added to it when the fluid runs out. Preferably, if the reservoir 104 is a refill unit, the reservoir 104 includes a body and a neck (not shown) and a drip-free quick connector (not shown) so that the reservoir 104 may be removed from dispenser 100 even if it contains fluid without leaking that fluid. Exemplary drip-free quick connectors are disclosed in U.S. Pat. No. 6,871,679 titled Bag and Dispensing System Comprising Such A Bag, and U.S. Pat. No. 7,647,954 titled Connector Apparatus And Method For Connecting The Same For Controlling Fluid Dispensing, which are incorporated herein by reference in their entirety.

Reservoir 104 contains a supply of a foamable liquid. In various embodiments, the contained foamable liquid could be for example a soap, a sanitizer, a cleanser, a disinfectant, or the like. The reservoir 104 may be a collapsible container and can be made of thin plastic or a flexible bag-like material. In other embodiments, the container may be a non-collapsing container formed by a rigid or semi-rigid housing, or any other suitable configuration for containing the foamable liquid without leaking. In the case of a non-collapsing container, a vent system may be included. Exemplary venting systems are disclosed in U.S. patent applications Publication No. 2015/0266657 titled Closed System for Venting a Dispenser Reservoir; Publication No. 2015/025184 titled Pumps With Container Vents and application Ser. No. 14/811,995, titled Vented Refill Units And Dispensers Having Vented Refill Units, which are incorporated herein by reference.

The exemplary multi-chamber sequentially activated pump disclosed herein is a very compact pump. The compactness allows for greater flexibility in dispenser design. The pump is especially useful in making dispensers in compliance with the Americans with Disabilities Act ADA, which prevents wall mounted dispensers from extending more than 5 inches from the wall. In addition, the multi-chamber sequentially activated pump disclosed herein uses less energy due to the unique dual flapper valve that is used for the liquid inlet valve and the liquid outlet valve.

Figure 2:
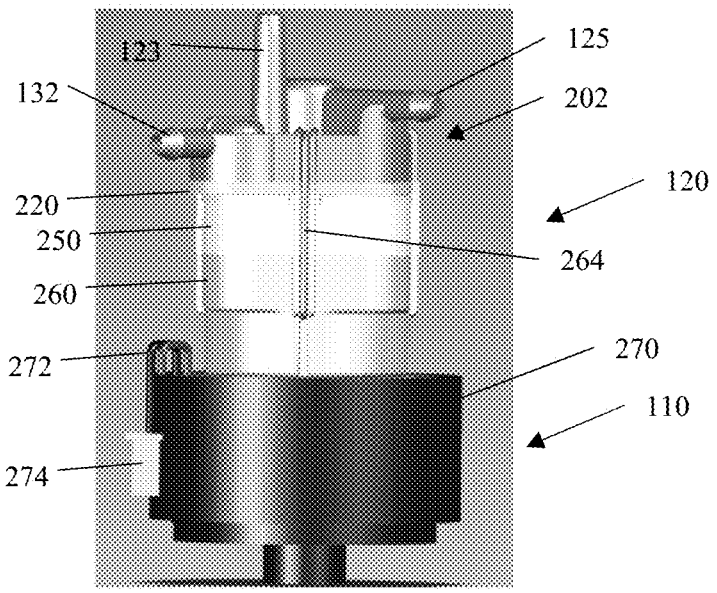
FIG. 2 is front view of a compact multi-chamber pump for use in foam-at-a-distance dispenser.

FIG. 2 is a front view of a multi-chamber sequentially activated pump for pumping both liquid and air to a remote foam generator. Pump 120 includes a manifold 202 that includes a liquid inlet 123, a liquid outlet 132 and an air outlet 125. Pump 120 also includes a valve plate 220, a diaphragm housing 250 and a drive housing 260. Manifold 202, vale plate 220, diaphragm housing 250 and drive housing 260 are secured together by spring clips 264. In this instance there are four spring clips 264. A drive motor 110 is included. Motor 110 is located within motor housing 270. Leads 272 and connector 274 are used to place drive motor 110 in circuit communications with power and control circuitry (not shown) for controlling the dispenser.

Figure 3:
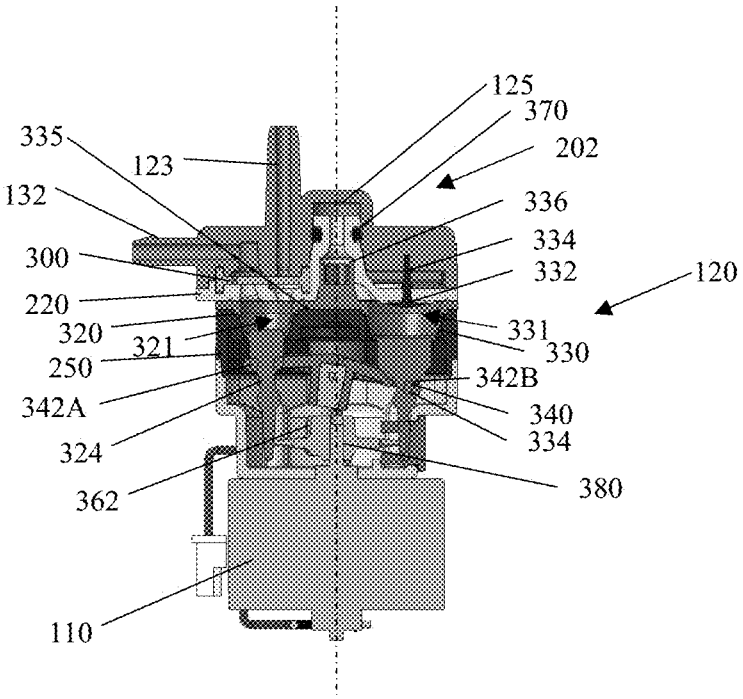
FIG. 3 is cross-sectional view of the compact multi-chamber pump for use in foam-at-a-distance dispenser.

FIG. 3 is a cross-section of the pump 120 and motor 110. Motor 110 is a DC motor and is located within motor housing 270. Motor 110 has a motor shaft 380. Motor shaft 380 is connected to an eccentric hub 362. Eccentric hub 362 is connected to a wobble plate 334. Wobble plate 334 includes a wobble palate wing 342A, 342B etc. for each diaphragm. As motor shaft 380 rotates, each wobble plate wing moves up and down in a sequential order. Upward movement of the wobble plate wing compresses its corresponding pump chamber, and downward movement of the wobble plate wing expands its corresponding pump chamber. In this instance there is one liquid pump diaphragm 320 and corresponding liquid pump chamber 321, and three air pump diaphragms 330 and corresponding air pump chambers 331 (only one is shown). Liquid pump diaphragm 320 has a stem 324 extending downward therefrom. Stem 324 is connected to wobble plate wing 342A by pulling the stem 324 through a hole 340 in the wobble plate wing 342A, trapping wobble plate wing 342A between the bottom of liquid pump diaphragm 320 and an expanded bulb portion of stem 342. Similarly, air pump diaphragm 330 has a stem 334 extending downward therefrom. Stem 334 is connected to wobble plate wing 342B by pulling the stem 334 through a hole 340 in the wobble plate wing 342B, trapping wobble plate wing 342B between the bottom of liquid pump diaphragm 330 and an expanded bulb portion of stem 334.

Liquid pump diaphragm 320 and air pump diaphragms 330 are formed in one molded diaphragm component 335. In this exemplary embodiment, there are three air pump diaphragms 330. In some embodiments, there are only two air pump diaphragms 330. In some embodiments, there are more then three air pump diaphragms 330.

Figure 7:
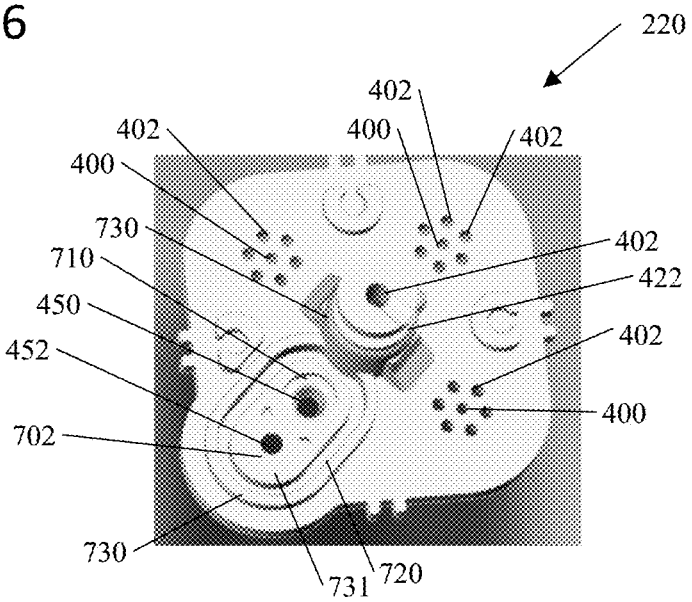
FIG. 7 is a plan view of a valve plate for use in the compact multi-chamber pump.
Figure 8:
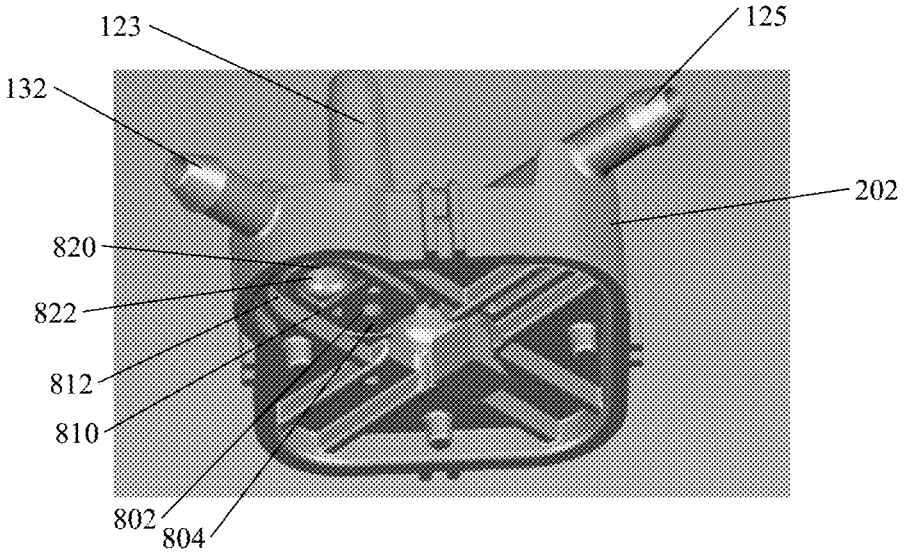
FIG. 8 is prospective view of the bottom of a manifold for use in the compact multi-chamber pump.

In addition, the molded multi-diaphragm component 335 may be molded with one or more air outlet valves 336. The one or more air outlet valves 336 extend upward and form a seal with the interior wall of upward extending cylindrical projection 730 (FIG. 7). The upward extending portions of the molded multi-diaphragm component 335 have two or more slits creating a plurality of upward extending tabs, with the tabs aligning with the outlet air path of each air pump chamber 331. Optionally the upward extending portion may be a solid cylindrical shape. When the air pump chamber 331 is compressed, air flows past the one-way air outlet valves 336.

Located in the interior of air pump chamber 330 is a one-way air inlet valve 332. One-way air inlet valve 332 is secured to valve plate 220 by stem 334, which is pulled up through valve retaining aperture 400, which is best seen in FIG. 7. One or more air holes 402 allow air to flow into air pump chamber 331 when air pump chamber 331 expands. One-way air inlet valve 332 forms a seal against the bottom of valve plate 220 when air pump chamber 331 is compressed.

Figure 4:
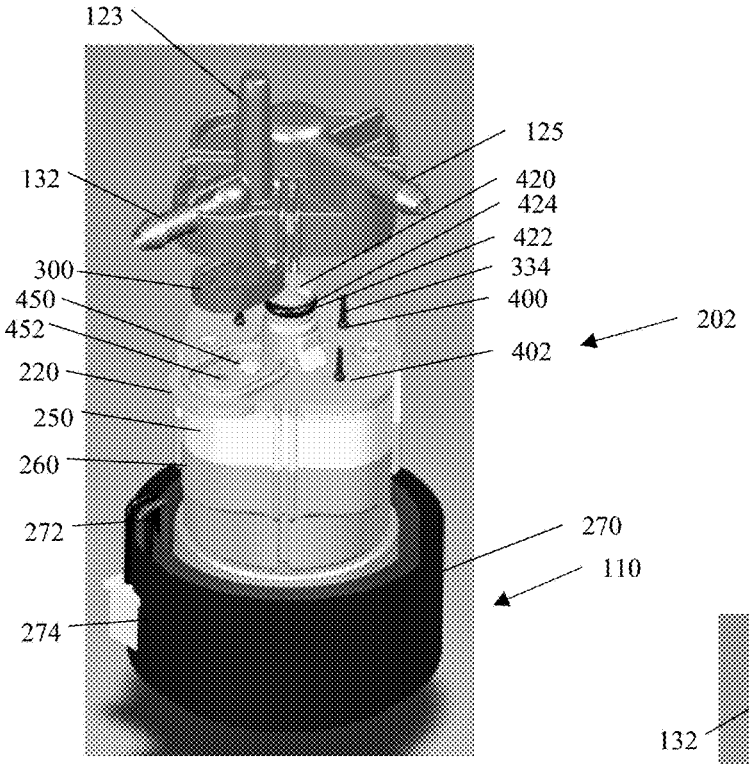
FIG. 4 is partial exploded view of the compact multi-chamber pump for use in foam-at-a-distance dispenser.
Figure 5:
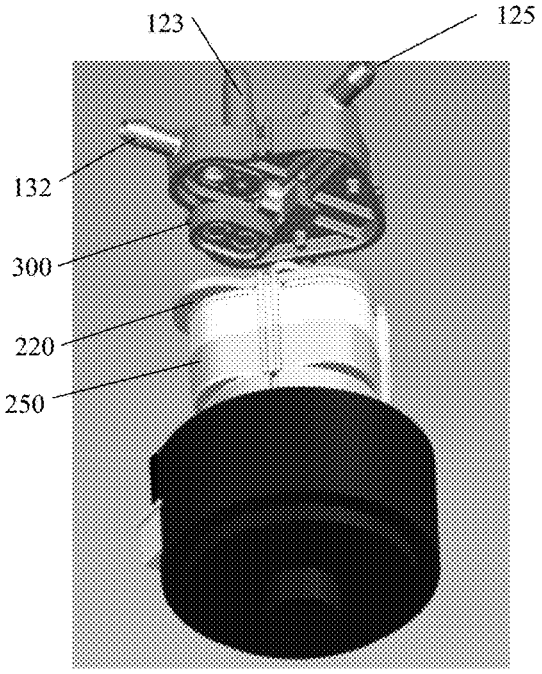
FIG. 5 is partial exploded view of the compact multi-chamber pump for use in foam-at-a-distance dispenser.
Figure 6:
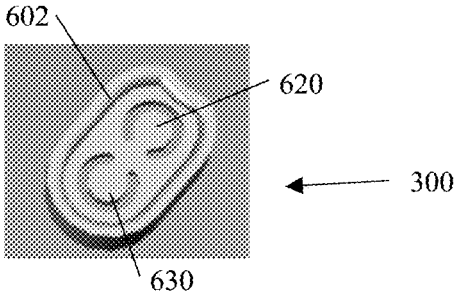
FIG. 6 is a plan view of a dual flapper valve for use in the compact multi-chamber pump.

Pump 202 includes a dual flapper valve 300. Dual flapper valve 300 is best illustrated in FIGS. 4-6. Dual flapper valve 300 includes a liquid inlet valve 620 and a liquid outlet valve 630. Dual flapper valve 300 includes an optional annular projection 602 that extends around its periphery. Annular projection 602 may be referred to as a tongue. Dual flapper valve 300 includes an optional second annular projection (not shown) on the bottom of dual flapper valve 300, that is substantially the same as the upward extending annular projection 602, except it extends downward.

FIG. 7 is a top prospective view of valve plate 220. As discussed above, valve plate 220 includes air inlet valve securing apertures 400 and a plurality of air inlet passages 402 extending therethrough. In this exemplary embodiment, there are three sets of air inlet valve securing apertures 400 and air inlet passages 402, one for each air pump diaphragm 331. An air outlet passage 402 also extends through valve plate 202. The air outlet passage 402 is located within cylindrical projection 730. Cylindrical projection 730 includes an annular groove 422 extending around its periphery. Annular groove 422 receives sealing member 424. Sealing member 424 may be, for example, an o-ring. Sealing member 424 seals against inside wall 370 of cylindrical passageway of manifold 202 to prevent leaking of air.

Valve plate 220 includes a liquid inlet passage 450. Located around liquid inlet passage 450 is a recessed portion 710. Recessed portion 710 allows liquid inlet valve 620 to deflect downward allowing liquid to flow past when liquid pump chamber 321 expands. When liquid pump chamber 321 compresses, liquid inlet valve 620 is pushed against liquid inlet valve seat 804 in manifold 202 to prevent fluid from flowing back up through liquid inlet passage 450. Valve plate 220 also includes a liquid outlet aperture 452. Liquid outlet valve seat 702 surrounds liquid outlet aperture 452. When liquid pump diaphragm expands, liquid outlet valve 630 forms a seal against liquid outlet valve seat 702 and prevents liquid from being drawn past liquid outlet valve 630.

Valve plate 220 includes an annular projection 730 and a raised surface 731, which forms an annular groove 720 that extends around liquid inlet aperture 450 and liquid outlet aperture 452. Annular groove 720 receives the lower annular projection 602 of dual flapper valve 300, which forms a liquid tight seal when the pump 120 is assembled.

Manifold 202 includes a raised surface 810 and has a liquid inlet aperture 802. Located around liquid inlet aperture 802 is a liquid inlet valve seat 804. Manifold 202 includes a liquid outlet aperture 820 and a recessed portion 822 located proximate liquid outlet aperture 820 so that liquid outlet valve 630 may move upward and allow liquid to flow past when liquid pump chamber 330 is compressed. An annular groove 812 extends around liquid inlet aperture 802 and liquid outlet aperture 820. Annular groove 812 receives annular projection 602 of dual flapper valve 300 to form a liquid tight seal when pump 120 is assembled.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. It is not the intention of the applicant to restrict or in any way limit the scope of the appended claims to such detail. Unless expressly excluded herein, all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order in which the steps are presented to be construed as required or necessary unless expressly so stated.

We claim:

1. A pump for pumping soap or sanitizer and air comprising:

a liquid pump diaphragm;

a dual flapper valve;

wherein a first flap of the dual flapper valve is a liquid inlet valve and a second flap of the dual flapper valve is a liquid outlet valve;

two or more air pump diaphragms;

a valve plate;

the valve plate comprising a liquid inlet passage;

a liquid outlet passage;

a liquid outlet valve seat;

two or more air inlet passages;

two or more air inlet valve anchors;

two or more air inlet valve secured to the valve plate; and a pump manifold;

the pump manifold having a liquid inlet valve seat.

2. The pump for pumping soap or sanitizer and air of claim 1 wherein the pump manifold comprises a liquid inlet, a liquid outlet and an air outlet.

3. The pump for pumping soap or sanitizer and air of claim 1 wherein one of the dual flapper valve and the valve plate comprises a groove and the other of the dual flapper valve and the valve plate comprises a tongue and wherein when assembled the tongue is located at least partially in the groove.

4. The pump for pumping soap or sanitizer and air of claim 3 wherein the tongue and groove encircle the liquid inlet passage and the liquid outlet passage.

5. The pump for pumping soap or sanitizer and air of claim 1 wherein the valve plate comprises an annular projection and wherein the dual flapper valve is located within the annular projection.

6. The pump for pumping soap or sanitizer and air of claim 1 wherein the dual flapper valve comprises an annular projection around a periphery thereof.

7. The pump for pumping soap or sanitizer and air of claim 1 further comprising one or more air outlet valves.

8. The pump for pumping soap or sanitizer and air of claim 7 wherein the one or more outlet valves seal against an interior of an air outlet passage of the valve plate.

9. The pump for pumping soap or sanitizer and air of claim 1 further comprising an air outlet passage, wherein the air outlet passage is located along a centerline of the pump.

10. The pump for pumping soap or sanitizer and air of claim 1 wherein the liquid inlet passage in the manifold is located off of a centerline of the pump.

11. A soap or sanitizer dispenser comprising:
a housing;
a foam dispensing outlet;
a reservoir;
a motor;
a wobble plate;
a pump;
wherein the pump comprises
a liquid pump diaphragm;
two or more air pump diaphragms;
a valve plate;
wherein the valve plate comprises
a liquid inlet passage;
a liquid outlet passage;
two or more air inlet passages;
an air outlet passage; and
a liquid outlet valve seat;
a manifold;
wherein the manifold includes a liquid inlet valve seat;
a dual flapper valve;
wherein one of the flaps of the dual flapper valve is a liquid inlet valve and the other flap of the dual flapper valve is a liquid outlet valve.

12. The soap or sanitizer dispenser of claim 11 wherein the foam dispensing outlet is located at least 6 inches from the pump.

13. The soap or sanitizer dispenser of claim 11 wherein the foam dispensing outlet is located at least 1 foot from the pump.

14. A pump for pumping soap or sanitizer and air comprising:
a multi-chamber diaphragm
the multi-chamber diaphragm comprising a liquid pump chamber and two or more air pump chambers;
a valve plate;
the valve plate having
a liquid inlet passage;
a liquid outlet passage;
a liquid outlet valve seat;
two or more air inlet passages;
two or more air inlet valve anchors;
two or more air inlet valve secured to the valve plate; and
a pump manifold;
the pump manifold having a liquid inlet valve seat; and
a dual flapper valve;
wherein a first flap of the dual flapper valves is a liquid inlet valve and a second flap of the dual flapper valve is a liquid outlet valve;
wherein a first periphery of the dual flapper valve forms a seal against the valve plate and a second periphery of the dual flapper valve forms a seal against the manifold.

15. The pump for pumping soap or sanitizer and air of claim 14 wherein the pump manifold comprises a liquid inlet, a liquid outlet and an air outlet.

16. The pump for pumping soap or sanitizer and air of claim 14 wherein one of the dual flapper valve and the valve plate comprises a groove and the other of the dual flapper valve and the valve plate comprises a tongue and wherein when assembled the tongue is located at least partially in the groove.

17. The pump for pumping soap or sanitizer and air of claim 16 wherein the tongue and groove are each located along one of the first and second peripheries of the dual flapper valve.

18. The pump for pumping soap or sanitizer and air of claim 14 wherein one of the dual flapper valve and the manifold comprises a groove and the other of the dual flapper valve and the manifold comprises a tongue and wherein when assembled the tongue is located at least partially in the groove.

19. The pump for pumping soap or sanitizer and air of claim 14 wherein an air outlet passage is located along a centerline of the pump.

20. The pump for pumping soap or sanitizer and air of claim 14 wherein the liquid inlet passage in the manifold is located off of a centerline of the pump.

* * * * *